US005774898A

United States Patent [19]

Malpee

[11] Patent Number: 5,774,898

[45] Date of Patent: Jul. 7, 1998

[54] ATHLETIC FOOTWEAR FOR SOFT TERRAIN

[76] Inventor: Mitchell G. Malpee, 316 Standard St., El Segundo, Calif. 90245

[21] Appl. No.: 643,240

[22] Filed: May 2, 1996

[51] Int. Cl.[6] ..... A41D 13/06

[52] U.S. Cl. ..... 2/239; 2/22; 36/8.1; 36/9 R

[58] Field of Search ..... 2/239, 61, 22, 2/241; 36/8.1, 4, 10, 9 R, 94, 102; 441/61, 64, 76

[56] References Cited

U.S. PATENT DOCUMENTS

| | | | |
|---|---|---|---|
| 246,454 | 8/1881 | Bruen | 2/61 |
| 366,503 | 7/1887 | O'Neill | 36/94 |
| 1,074,595 | 10/1913 | Aumont | 2/239 |
| 1,150,702 | 8/1915 | Pierce | 36/8.1 |
| 1,308,483 | 7/1919 | Craighead | 2/239 |
| 1,314,356 | 8/1919 | Nordblad | 2/239 |
| 1,319,680 | 10/1919 | Lieben | 36/8.1 |
| 1,349,095 | 8/1920 | Parisi | 36/94 |
| 1,402,375 | 1/1922 | Parisi | 36/94 |
| 1,798,201 | 8/1931 | Hedges | 2/239 |
| 2,248,303 | 2/1941 | Morgenroth | 2/239 |
| 3,013,564 | 12/1961 | Levey . | |
| 3,128,763 | 4/1964 | Langenfeld et al. | 2/239 |
| 3,967,390 | 7/1976 | Anfruns | 2/239 |
| 4,069,600 | 1/1978 | Wise | 36/10 |
| 4,276,671 | 7/1981 | Melton | 36/9 R |
| 4,294,022 | 10/1981 | Stockli et al. | 36/9 R |
| 4,651,354 | 3/1987 | Petrey | 2/239 |
| 4,852,272 | 8/1989 | Chilewich et al. | 2/239 |
| 5,020,164 | 6/1991 | Edwards | 2/239 |
| 5,205,071 | 4/1993 | Hergenroeder | 36/8.1 |
| 5,226,194 | 7/1993 | Staley | 2/239 |

*Primary Examiner*—Amy B. Vanatta
*Attorney, Agent, or Firm*—Ladas & Parry

[57] ABSTRACT

The disclose invention is of a foot protective covering designed for beach and water wear which embodies three portions: a permeable elastic portion on the top of the foot; an insulative portion on the bottom of the foot from the heel to the base of the toes; and a toe portion of flexible elastic on the bottom and sides of the toes. The toes may be webbed by adding material connecting the sides of the toes to one another to provide increased propulsion when swimming. Additional material may be added to the interior of the covering to increase insulation or to decrease friction when the article is being donned or removed.

42 Claims, 1 Drawing Sheet

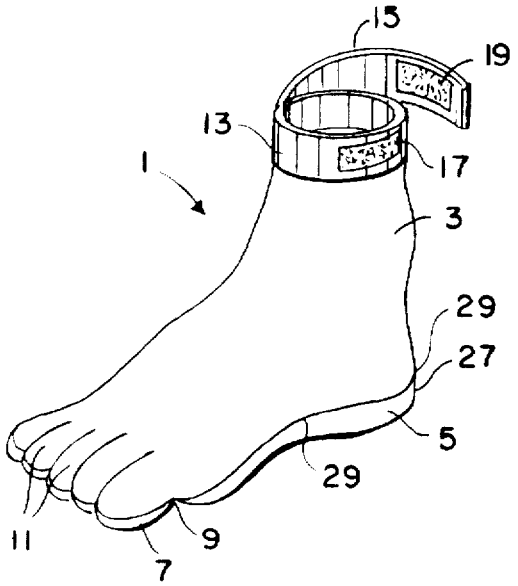
FIG. 1
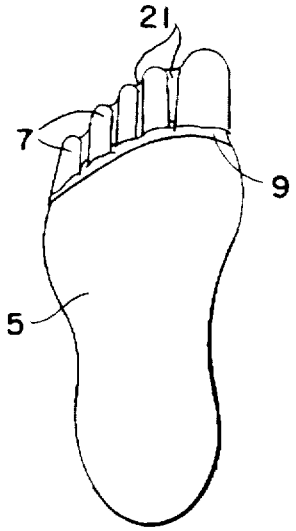
FIG. 2
FIG. 3
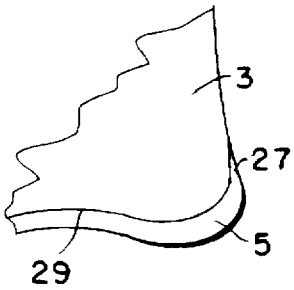
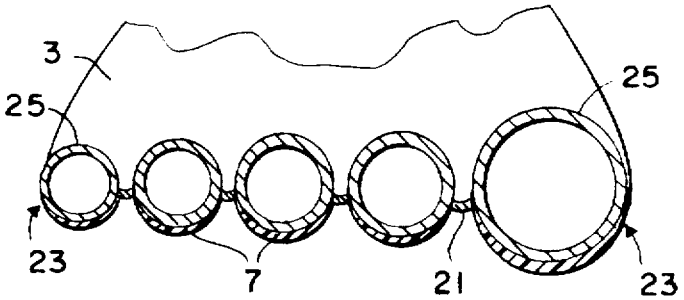
FIG. 4
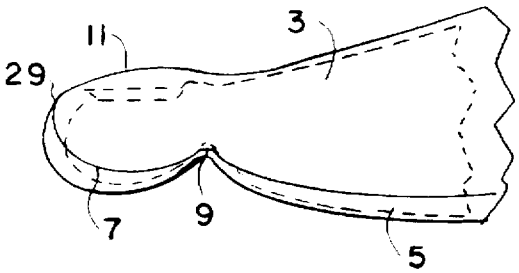
FIG. 5

ATHLETIC FOOTWEAR FOR SOFT TERRAIN

BACKGROUND OF THE INVENTION

1. Field of the Invention

This invention relates to footwear for active people who frequent a beach and the water along the beach. The footwear provides protection from a beach environment; yet, it also allows maximum movement of the muscles and joints of the foot to increase a user's agility when the user is treading on soft terrain.

2. Brief Description of the Prior Art

In the past, people who work or play on the beach or who must traverse the beach to enter the water have not had footwear available which would protect their feet from the sun, block the infiltration of sand between the footwear and a user's feet, allow fluids to evaporate from the foot, insulate the bottom of the foot from hot sand, and allow unimpeded movement of the muscles and joints of the foot.

There have been many inventions which relate to foot coverings. For example, U.S. Pat. No. 1,308,483 to Craighead discloses a stocking which is made of a single material and incorporates enlarged separate pockets for each toe.

A foot slipper to correct deformities of the toes is disclosed by Levey in U.S. Pat. No. 3,013,564. The slipper provides an arch support with a sock inside the lining of the slipper to provide an inner lining for the slipper.

U.S. Pat. No. 3,128,763 to Lengenfeld discloses a stocking with separate pockets for each toe and with a pad or tubular strip around each pocket to prevent foot ills and to permit the application of medication at points between and around the toes. The stocking itself is made of a single stretchable material.

A version of a shoe with individual compartments for each toe is disclosed in U.S. Pat. No. 3,967,390 to Anfruns. Each toe compartment has a sole portion, an upper portion, and a flexible portion between the two. An indentation is provided in the sole at the base of the toes which allows the toe area to pivot, but does not allow the toes to grasp. The sole is typically made of a strong natural leather or synthetic plastic and the upper portion is usually made of soft leather.

U.S. Pat. No. 4,651,354 to Petrey discloses a lightweight foot covering made of a single stretchable fabric with a plurality of pads disposed on the bottom of the covering at key locations where the foot contacts the ground to provide increased traction to the covering. The remainder of the foot covering is made of a stretchable fabric.

U.S. Pat. No. 5,020,164 discloses an insulative stocking made from two pieces of neoprene without toe pockets. It is seamed and covered on either side with a moisture permeable fabric. It may include holes to facilitate the ventilation thereof.

U.S. Pat. No. 1,314,356 discloses a stocking with overlapping toe pockets to reduce chafing between the toes. A single material is used.

U.S. Pat. No. 2,248,303 discloses a foot bandage having marked toe portions therein. The toe portions are not separated toe pockets, and the device is intended to be coated with medication for treatment of chafing of the feet. A single material is used.

U.S. Pat. No. 1,798,201 discloses a stocking wherein only the first, third, and fifth toes have pockets, and the second and forth toes protrude from the stocking. A single material is used to make the stocking.

U.S. Pat. No. 4,069,600 discloses an athletic foot protector comprised of a porous elastic sock which has a layer of absorbent material and a layer of rubber or latex. This sock includes openings to vent perspiration. The sock is intended to protect against sheer force that may cause trauma to the foot.

U.S. Pat. No. 5,226,194 discloses a sock comprised of two layers. The inner layer is of a moisture permeable material, while the outer layer is comprised of an absorbent material. A vent is defined therein.

The above-noted prior art footwear provide protection for a foot or provide better foot contact with the ground, but they are not designed for the unique environmental conditions found in and around beach and shore areas. These environmental conditions of increased sun and heat, decreased ground firmness, and high humidity and sand infiltration are most often found together along the ocean shore. In combination, these conditions have detrimental effects upon the human foot, and there is a need for footwear which is designed to combat the effects of this environment.

SUMMARY OF THE INVENTION

The present invention provides unique footwear to protect a user's feet from the environmental conditions found along a beach, yet, the footwear also aids a user in traversing sand found in beach areas. The present invention provides the above attributes as follows: the footwear encases the bottom of the toes in an extremely elastic and flexible material to allow full motion of the toes so they can "grab" the sand when the user is walking or running; it covers the bottom of the foot in a flexible and insulative material which allows the foot joints to articulate while walking or running and also protects a user's foot from heat emanating from the sand; and the footwear inhibits sand infiltration between the footwear and a user's foot while protecting a user's foot from the sun's harmful ultraviolet radiation and allowing water to evaporate from a user's foot.

BRIEF DESCRIPTION OF THE DRAWING

These and other features, aspects, and advantages of the present invention will become better understood with regard to the following description, appended claims, and accompanying drawing where:

FIG. 1 is a left frontal perspective view of the footwear configured to fit a user's left foot;

FIG. 2 is a view of the bottom of the footwear;

FIG. 3 is a partial side view of the foot glove showing the connection of the bottom part to the top part at the heel of the foot glove;

FIG. 4 is a cross section across the toe portion, looking toward the rear of the foot glove; and FIG. 5 is a partial side view of the foot glove showing the connection of the toe base portion with the bottom portion, part of a user's foot shown in phantom.

DETAILED DESCRIPTION OF THE PREFERRED EMBODIMENT

In the preferred embodiment shown in FIG. 1, the footwear is designed as a "foot glove" 1 and it is composed of three different portions, each portion being made of a different material so as to provide appropriate protection, breatheability, and mobility to the area of a foot covered by each portion. The top portion 3 is comprised of spandex (e.g., LYCRA®) or a spandex-like (e.g., LYCRA® like) material to provide protection from the sun, allow evaporation of water from the foot and inhibit sand from infiltrating between the footwear and a user's foot, thus causing discomfort to the user. The top portion may have an extension portion connected to the top portion and extending past the ankle to a point below the knee. The bottom portion 5 is comprised of a solid but flexible neoprene or neoprene-like material to provide protection from ground emanating heat, to allow the necessary limited foot articulation present during walking or running, and to inhibit sand or dirt from infiltrating between the footwear and a user's foot, thus causing discomfort to the user. The toe base portion 7 is comprised of a more flexible latex or latex-like material to allow maximum mobility of the toes, and to inhibit infiltrating of sand or dirt between the footwear and a user's foot, thus causing discomfort to the user.

Optionally, as best viewed in FIGS. 2 and 4, the foot glove 1 may include webbing 21 between the toe pockets 11 to provide increased traction on the land when traversing same, and increased propulsion in the water when swimming. The foot glove 1 may also contain a tubular shaped, low friction, flexible material 25 attached on the interior walls or portion thereof of the toe pockets 11 to provide insulation and to ease the donning and removing of the foot glove 1 from a user's foot. The tubular material is flexible enough to permit unimpeded bending of the toes and to be comfortable for the wearer, but has the property of being more shape-sustaining than the spandex-like (e.g., LYCRA®-like) material of the top portion 3.

Returning to FIG. 1, in the preferred embodiment of the invention, the bottom portion 5 is shown to be thinned as it connects with the top portion 3 at the rear above the heel of the foot glove 1, since the thickness of the neoprene away from the part of the bottom portion 5 which contacts a walking surface must be thick enough to perform its aforementioned function, and it is then only necessary to bond the top of the heel 27, as well as the lateral edges 29 of the bottom portion 5 to the spandex-like (e.g., LYCRA®-like) material of the top portion 3. The preferred bonding technique is to have a continuous transition between the two different types of materials at the transition point, the thicker neoprene material being thinned progressively as it merges into the spandex-like (e.g., LYCRA®-like) material of the top portion 3, the bonding of the two materials being accomplished by any known bonding technique, such as heat sealing or gluing.

In front of the ball of the foot, the bottom portion 5 narrows and ends at a transition region 9 where it merges and is bonded to the toe base portion 7, again by any known heat seal or gluing process. The transition region 9, of course, must be continuous across the width of the bottom of the foot glove in order to not permit the encroachment of dirt or sand.

The toe base portion 7 is preferably a single unitary molded latex piece having a narrow edge which can bond to the bottom portion 5 along transition region 9 as described above. The base of each toe is thicker than the thickness of the toe base portion 7 in the transition region 9, and this is best seen in FIG. 5. FIG. 5 also shows the gradual reduction of thickness of the toe base portion 7 where it merges with the top portion 3 along an edge 29, these two materials of toe base portion 7 and top portion 3 being bonded using the same techniques as described above.

The connection between the top portion 3 and the toe base portion 7 on each of the toe pockets 11 is preferably just below the centerline of the toes, i.e. the point of connection of the two materials is located at a position which will not be uncomfortable to the user. For so long as the transition is made smoothly, this is not a critical factor, but, even with a heal seal bonding technique, the latex material will have components up to about the mid-position of each toe, and this is an ideal position for the transition point, since bending of the toes sideways, especially in a volleyball game, for example, will give the protection for the user along the sides of the toes. Accordingly, although the transition between the top portion 3 and the toe base portion 7 for each of the toe pockets is not defined by a clear line of demarcation, due to the flowing of one material into the other, nevertheless, the latex material ideally comes up to the mid-portion of each toe pocket.

The foot opening at the top of the foot glove 1 is shown to be surrounded by an elastic band 13 in FIG. 1. While an elastic band of this type would generally be sufficient for most purposes, in a more aggressive active sport, such as volleyball, additional leg support is beneficial. Toward that end, a strap 15, which may have stronger elasticity than the elastic band 13 or may be inelastic, is shown attached at one side of the foot glove and may be wrapped around the rear of the elastic band 13 so as to connect with the elastic band 13 on the opposite side of the foot glove. In order to connect the end of strap 15 to the elastic band 13, a patch of hook material 19 is fixed on the end of strap 15 while a patch of loop material 17 is fixed to the side of the foot glove 1. If desired, the band 15 may be made of leather or nylon strap material and wrap about itself in place of, or in addition to, elastic band 13 for even additional leg support. obviously, the hook and loop patches 19, 17 can be easily coupled and uncoupled by manipulating the end of strap 15 as is a common technique using hook and loop materials in a variety of known applications.

As best seen in FIG. 4, the bottoms of the base portion 7 for each toe pocket is thicker at the bottom and narrows as it approaches the connecting point with the top portion 3 material. The webs 21 between toe pockets 11, being formed of the spandex-like (e.g., LYCRA®-like) material of the top portion 3, is very flexible and stretchable and will not interfere with the movement of the toes individually, and yet will provide additional propulsion by the wearer when treading water.

In another aspect of the invention, the foot glove is comprised of a top portion and a sole, wherein the sole is comprised of two different materials, a first material, preferably of flexible neoprene, making up the bulk of the sole from the heel to the base of the toes, and a toe base portion underlying the toes and preferably made of a more flexible latex material. The material of the top portion may, or may not, be the same as either material of the sole.

In yet another aspect of the invention, there is provided a foot glove having toe pockets 11 wherein the top portion of each toe pocket is made of a porous material, while the bottom portion of each toe pocket is made of a material which allows independent unimpeded motion of each toe and inhibits the infiltration of sand between said toe base portion and the foot, the preferred material being a latex or a latex-like material.

It is to be understood that the above described embodiments of the invention are merely illustrative of the principles thereof and that numerous modifications and embodiments of the invention may be derived within the spirit and scope thereof. For example, instead of forming the toe base portion 7 as a single integral unit, the neoprene base portion 5 may be thinned considerably from its thickness as a base portion for the foot glove, the thinned portion spanning the transition region 9 and forming very thin layers of neoprene underneath each toe and connecting with the top portion 3 in a manner similar to that described in coupling the latex toe base portions 7 to the material of the top portion 3 by bonding techniques, and the toe base portion 7 would then comprise individual toe base pads heat bonded or glued to the thinned neoprene layer under the respective toes. In this manner, the transition point 9, being made of the thinned neoprene material, would act as a flexible hinge for the toes, and the thickness would be chosen so that the bending of one toe would not interfere with the bending of an adjacent toe.

I claim:

1. A foot glove constructed of a plurality of parts, comprising:

a top portion extending frog the ankle to the heel of said foot and from the ankle to the toes across the dorsum of the foot, said top portion being made of a first material;

a bottom portion connecting with said top portion and extending from the heel across the bottom of the foot to the base of the toes, said bottom portion being made of a second material; and a toe base portion covering the bottom of the toes, connecting with said bottom portion at the base of the toes and defining the bottom of each of a plurality of toe pockets, said toe base portion being made from a third material, said toe base portion connecting with said top portion, said top portion defining the top of said plurality of toe pockets, wherein the third material is more flexible than the second material.

2. The foot glove of claim 1 wherein the third material is latex material.

3. The foot glove of claim 2 wherein the second material is neoprene material.

4. The foot glove of claim 3 wherein the first material is spandex material.

5. The foot glove of claim 1 further comprising an extension portion connected to said top portion and extending past the ankle to a point below the knee.

6. The foot glove of claim 1 wherein the spaces between toe pockets of the foot glove are webbed.

7. The foot glove of claim 1 wherein said toe pockets have a fourth material on at least a portion of their inside surface to aid in insertion and removal of the toes from the pockets.

8. The foot glove of claim 1 further comprising a strap having a first portion and a second portion, the first portion of the strap being connected to the foot glove, the strap tightening the glove about a user's limb when the second portion of the strap is connected to the foot glove.

9. A foot glove as claimed in claim 1, wherein the bottom portion covers the entire bottom of the foot from the heel to the base of the toes, and wherein the toe base portion covers the entire bottom of the toes.

10. A foot glove as claimed in claim 1, wherein the foot glove has five toe pockets.

11. A foot glove as claimed in claim 6, wherein the toe base portion is connected to the bottom portion at a transition region, wherein each toe pocket has a first end and a second end, the first end being connected to the base portion at the transition zone, the second end being opposite the first end and adjacent to a tip of a toe when the foot glove is worn by a user, wherein the toe pockets are spaced apart by webbing and do not touch each other, and wherein the webbing extends from the first end to the second end of each toe pocket.

12. A foot glove as claimed in claim 7, wherein the fourth material is tubular-shaped and more shape-sustaining than the first material.

13. A foot glove as claimed in claim 1, further comprising;

an extension portion connected to the top portion, the extension portion extending past the ankle to a point below the knee; and a strap having a first portion and a second portion, the first portion of the strap being connected to the extension portion, the strap tightening the extension portion about a user's limb when the second portion of the strap is connected to the foot glove, wherein the second portion of the strap has a means for connecting the second portion to the foot glove.

14. A foot glove for covering a foot, comprising:

a top portion;

a bottom portion; and a toe base portion; and wherein said top portion extends from the ankle to the heel and from the ankle to the toes covering the dorsum of the foot;

said top portion is made of a first material which protects the dorsum of the foot from ultraviolet radiation, inhibits sand infiltration between the dorsum of the foot and said top portion, and allows the movement of fluid by osmosis across the top portion material between the dorsum of the foot and the external environment;

said bottom portion connects with said top portion and extends from the heel across the sole of the foot to the base of the toes;

said bottom portion is made of a second material which insulates the sole of the foot from heat radiating from the ground, when the foot glove is being worn on a user's foot and the user is walking, running, or standing, which inhibits the infiltration of sand between said sole of the foot and said bottom portion, and which allows articulated movement of the joints and ligaments of the foot;

said toe base portion comprises the bottom of a plurality of toe pockets, said toe base portion connecting with said bottom portion at the base of the toes, said toe base portion individually encasing the bottom and sides of each toe, said toe base portion connecting with the top portion, said top portion defining the top of each of said plurality of toe pockets; and said toe base portion is made of a third material which allows independent unimpeded motion of each toe and inhibits the infiltration of sand between said toe base portion and the foot, wherein the third material is more flexible than the second material.

15. The foot glove of claim 14, further comprising an extension portion connected to said top portion, and extending past the ankle to a point below the knee.

16. The foot glove of claim 14, wherein the spaces between toe pockets of the foot glove are webbed.

17. The foot glove of claim 14 wherein said toe pockets have a fourth material on at least a portion of their inside surfaces to aid in insertion and removal of the toes from the pockets.

18. The foot glove of claim 14 further comprising a strap having a first portion and a second portion, the first portion of the strap being connected to the foot glove, the strap tightening the glove about a user's limb when the second portion of the strap is connected to the foot glove.

19. A foot glove as claimed in claim 14, wherein the bottom portion covers the entire bottom of the foot from the heel to the base of the toes, and wherein the toe base portion covers the entire bottom of the toes.

20. A foot glove as claimed in claim 14, wherein the foot glove has five toe pockets.

21. A foot glove as claimed in claim 16, wherein the toe base portion is connected to the bottom portion at a transition region, wherein each toe pocket has a first end and a second end, the first end being connected to the base portion at the transition zone, the second end being opposite the first end and adjacent to a tip of a toe when the foot glove is worn by a user, wherein the toe pockets are spaced apart by webbing and do not touch each other, and wherein the webbing extends from the first end to the second end of each toe pocket.

22. A foot glove as claimed in claim 17, wherein the fourth material is tubular-shaped and more shape-sustaining than the first material.

23. A foot glove as claimed in claim 14, further comprising:

an extension portion connected to the top portion, the extension portion extending past the ankle to a point below the knee; and a strap having a first portion and a second portion, the first portion of the strap being connected to the extension portion, the strap tightening the extension portion about a user's limb when the second portion of the strap is connected to the foot glove, wherein the second portion of the strap has a means for connecting the second portion to the foot glove.

24. A foot glove constructed of a plurality of parts, comprising:

a top portion extending from the ankle to the heel of said foot and from the ankle to the toes across the dorsum of the foot;

a bottom portion connecting with said top portion and extending from the heel across the bottom of the foot to the base of the toes; and a toe base portion covering the bottom of the toes, connecting with said bottom portion at the base of the toes and defining the bottom of five toe pockets, said toe base portion connecting with said top portion, said top portion defining the top of said toe pockets, wherein spaces between said toe pockets are webbed.

25. The foot glove of claim 24 wherein said toe base portion is made from latex material.

26. The foot glove of claim 25 wherein said bottom portion is made from neoprene material.

27. The foot glove of claim 26 wherein said top portion is made from spandex material.

28. The foot glove of claim 24 further comprising a strap having a first portion and a second portion, the first portion of the strap being connected to the foot glove, the strap tightening the glove about a user's limb when the second portion of the strap is connected to the foot glove.

29. A foot glove as claimed in claim 24, wherein the toe base portion is connected to the bottom portion at a transition region, wherein each toe pocket has a first end and a second end, the first end being connected to the base portion at the transition zone, the second end being opposite the first end and adjacent to a tip of a toe when the foot glove is worn by a user, wherein the toe pockets are spaced apart by webbing and do not touch each other, and wherein the webbing extends from the first end to the second end of each toe pocket.

30. A foot glove as claimed in claim 24, further comprising:

an extension portion connected to the top portion, the extension portion extending past the ankle to a point below the knee; and a strap having a first portion and a second portion, the first portion of the strap being connected to the extension portion, the strap tightening the extension portion about a user's limb when the second portion of the strap is connected to the foot glove, wherein the second portion of the strap has a means for connecting the second portion to the foot glove.

31. A foot glove as claimed in claim 24, wherein the toe pockets have a fourth material on at least a portion of their inside surface to aid in insertion and removal of the toes from the pockets, wherein the fourth material is tubular-shaped and more shape-sustaining than the first material.

32. A foot glove constructed of a plurality of parts, comprising:

a top portion extending from the ankle to the heel of the foot and from the ankle to the toes across the dorsum of the foot, the top portion being made of a first material;

a bottom portion connecting with the top portion and extending from the heel across the bottom of the foot to the base of the toes, the bottom portion covering the entire bottom of the foot from the heel to the base of the toes, the bottom portion being made of a second material; and a toe base portion covering the entire bottom of the toes, the toe base portion connecting with the bottom portion at the base of the toes at a transition region, the toe base portion defining the bottom of each of a plurality of toe pockets, the toe base portion being made from a third material that allows independent motion of each toe, the toe base portion connecting with said top portion, the top portion defining the top of the plurality of toe pockets, wherein the toe base portion is more flexible than the entire bottom portion.

33. The foot glove of claim 32 wherein the third material is latex material.

34. The foot glove of claim 33 wherein the second material is neoprene material.

35. The foot glove of claim 34 wherein the first material is spandex material.

36. The foot glove of claim 32 wherein the toe pockets have a fourth material on at least a portion of their inside surface to aid in insertion and removal of the toes from the pockets, wherein the fourth material is tubular-shaped and more shape-sustaining than the first material.

37. A foot glove as claimed in claim 32, wherein spaces between the toe pockets are webbed with webbing, wherein each toe pocket has a first end and a second end, the first end being connected to the base portion at the transition zone, the second end being opposite the first end and adjacent to a tip of a toe when the foot glove is worn by a user, wherein the toe pockets are spaced apart by the webbing and do not touch each other, and wherein the webbing extends from the first end to the second end of each toe pocket.

38. A foot glove as claimed in claim 32, further comprising:

an extension portion connected to the top portion, the extension portion extending past the ankle to a point below the knee; and a strap having a first portion and a second portion, the first portion of the strap being connected to the extension portion, the strap tightening the extension portion about a user's limb when the second portion of the strap is connected to the foot glove, wherein the second portion of the strap has a means for connecting the second portion to the foot glove.

39. A foot glove as claimed in claim 32, wherein the entire toe base portion is more flexible than the entire bottom portion.

40. A foot glove as claimed in claim 32, wherein the fourth material is flexible enough to permit unimpeded bending of the toes.

41. A foot glove constructed of a plurality of parts, comprising:

a top portion extending from the ankle to the heel of the foot and from the ankle to the toes across the dorsum of the foot, the top portion being made of a first material;

a bottom portion connecting with the top portion and extending from the heel across the bottom of the foot to the base of the toes, the bottom portion being made of a second material; and a toe base portion covering the bottom of the toes, the toe base portion connecting with the bottom portion at the base of the toes at a transition zone, the toe base portion defining the bottom of five toe pockets, the toe base portion being made from a third material, the toe base portion connecting with the top portion, the top portion defining the top of the toe pockets, wherein the toe pockets have a fourth material on at least a portion of their inside surface to aid in insertion and removal of the toes from the pockets, wherein the fourth material is tubular-shaped and more shape-sustaining than the first material.

42. A foot glove as claimed in claim 41, wherein the first material is spandex material, the second material is neoprene material, and the third material is latex material.

* * * * *